US005443322A

United States Patent [19]

Jozat et al.

[11] Patent Number: 5,443,322

[45] Date of Patent: Aug. 22, 1995

[54] FLOW CONTROL FOR WRITING OR DRAWING INSTRUMENT

[75] Inventors: Walter Jozat, Bad Bramstedt; Steffen Wünsche, Hamburg, both of Germany

[73] Assignee: rotring International GmbH & Co. KG, Hamburg, Germany

[21] Appl. No.: 222,394

[22] Filed: Apr. 4, 1994

[30] Foreign Application Priority Data

Apr. 19, 1993 [DE] Germany ..... 43 13 180.8

[51] Int. Cl.[6] ..... B43K 8/18; B43K 5/18; B43K 7/10

[52] U.S. Cl. ..... 401/151; 401/145; 401/195; 401/258

[58] Field of Search ..... 401/145, 151, 195, 258

[56] References Cited

U.S. PATENT DOCUMENTS

| | | | |
|---|---|---|---|
| 3,737,242 | 6/1973 | Hesebeck et al. | 401/157 |
| 4,350,458 | 9/1982 | Murahara et al. | 401/145 |
| 4,573,819 | 3/1986 | Herrning | 401/151 |
| 4,634,305 | 1/1987 | Herrnring | 401/151 |
| 4,708,506 | 11/1987 | Herrnring | 401/151 |
| 5,336,007 | 8/1994 | Jozat | 401/151 |

FOREIGN PATENT DOCUMENTS

| | | |
|---|---|---|
| 2035526 | 1/1972 | Germany . |
| 3321301 | 12/1984 | Germany . |
| 4013011 | 3/1991 | Germany . |

*Primary Examiner*—Steven A. Bratlie

*Attorney, Agent, or Firm*—Fitzpatrick, Cella, Harper & Scinto

[57] ABSTRACT

A writing or drawing instrument including a writing tip (1) disposed at a front end of the writing instrument which can be brought into contact with a writing or drawing pad, a writing fluid reservoir (7) for supplying the writing tip (1) with writing fluid, and a writing fluid chamber (9) disposed between the writing tip (1) and the writing fluid reservoir (7). The writing fluid chamber (9) consists of a bubble of a flexible, inelastic material. The writing fluid chamber (9) is connected to the writing tip (1) on one side and is connected on the other side to a barrier (12). The barrier (12) is connected with the writing fluid reservoir (7) and can be opened in a controlled manner. When a lower fill level is reached in the writing fluid chamber (9), the barrier is briefly opened to fill the writing fluid chamber (9). During the filling of the writing fluid chamber (9), the volume of the writing fluid reservoir (7) is reduced in accordance with the consumption of the writing fluid.

20 Claims, 3 Drawing Sheets

FLOW CONTROL FOR WRITING OR DRAWING INSTRUMENT

BACKGROUND OF THE INVENTION

1. Field of Invention

The invention relates to a writing or drawing instrument with a writing tip provided at the front end which can be brought into contact with a writing or drawing pad, and with a writing fluid reservoir for supplying the writing tip with writing fluid, the volume of which is reduced as the writing fluid is used up.

2. Brief Description of the Prior Art

In a known writing or drawing instrument of this type (German Published, Non-Examined Patent Application DE-OS 20 35 526, equivalent to U.S. Pat. No. 3,737,242), the walls of the writing fluid reservoir are essentially formed by a thin, flexible foil which is deformed when subjected to small pressure loads. The writing fluid reservoir is connected by its front end with the writing tip, but otherwise is sealed with respect to the ambient air. This means that the writing or drawing instrument does not have a pressure equalization system which receives writing fluid and which is in contact with the ambient air. If writing fluid from the writing fluid reservoir, which contains practically no air, is used up, the flexible foil is deformed under the effect of the ambient pressure in such a way that the volume of the writing fluid reservoir is appropriately reduced. Thus, the ambient pressure always acts on the writing fluid in the writing fluid reservoir. Pressure increases in the writing fluid reservoir on account of the expansion of air caused by increases in temperature do not occur with this known writing or drawing instrument, because practically no air is contained in the writing fluid reservoir.

This particular writing or drawing instrument does avoid certain known disadvantages from using a pressure equalization system, such as drying out of the writing fluid in the pressure equalization system, emergence of writing fluid from the pressure equalization system into the ambient air, or considerable manufacturing expense. However, this known writing or drawing instrument has a disadvantage in that the entire static pressure of the writing fluid in the writing fluid reservoir rests on the writing tip, so that there is a danger of writing fluid dripping at the tip. Attempts to reduce or remove the danger of dripping by means of a considerable increase in the capillary forces in the area of the writing tip would reduce the drawing speed of the writing or drawing instrument. The emergence of writing fluid during the writing or drawing process is made more difficult whenever there is an increase in capillary forces.

OBJECT AND SUMMARY OF THE INVENTION

It is an object of the invention to design a writing or drawing instrument of the previously mentioned type in such a way that the static pressure of the writing fluid acting on the writing tip will be at a minimum.

To attain this object, a writing or drawing instrument of the previously mentioned type is designed in accordance with the invention with a writing fluid chamber having at least one wall of a flexible, but inelastic material. The writing fluid chamber is connected with the writing tip on one side and is connected on the other side with the writing fluid reservoir via a barrier which can be opened in a controlled manner. The barrier is opened when a lower fill level is reached in the writing fluid chamber, and is closed when an upper fill level is reached in the writing fluid chamber.

Thus, a writing or drawing instrument according to the invention has a writing fluid chamber between the writing fluid reservoir and the writing tip. This writing fluid chamber supplies the writing tip with writing fluid. Normally this writing fluid chamber is separated from the writing fluid reservoir by a barrier. Thus, only the static pressure of the writing fluid in the writing fluid chamber, which generally is disposed very close to the rear end of the writing tip, rests on the writing tip. This pressure is very low, so that the capillary forces required to prevent dripping of writing fluid from the writing tip also need to be only comparatively low. In this way, not only is the danger of dripping from the writing or drawing instrument clearly reduced, but moreover a faster drawing speed is made possible.

When the writing fluid chamber has been emptied down to the lower fill level, the barrier is briefly removed so writing fluid may reach the writing fluid chamber from the writing fluid reservoir. This step is performed rapidly so that no increase in static pressure builds up at the writing tip. Therefore, there is no danger of dripping occurring in the area of the writing tip, even during filling of the writing fluid chamber.

It is already known from one reference (German Patent DE-PS 40 13 011) that a buffer chamber may be provided between a writing fluid reservoir and a writing fluid chamber in a writing or drawing instrument. The fill level of that buffer chamber is monitored, and the buffer chamber is filled with writing fluid from the writing fluid reservoir when the fill level falls below a minimum. Aside from the fact that a pressure equalization system is provided in that writing or drawing instrument, the buffer chamber is always connected to the writing fluid reservoir, so that the entire static pressure of writing fluid in the reservoir and buffer chamber always will be present at the writing tip.

In a preferred embodiment of a writing or drawing instrument according to the invention, the writing fluid chamber is in the shape of a bubble with a wall consisting of a flexible, inelastic material. Suitable materials for such a bubble are, for example, latex, plasticized PVC, polyethylene, or polyester, and the surface of the bubble can be metallized to reduce permeability. This bubble can be located between the barrier and the tip, and can be respectively connected with the barrier and tip via a tube-shaped connector.

The barrier preferably is opened and closed electrically, and can consist of a solenoid valve, for example, which is briefly opened for filling the writing fluid chamber. Alternatively, for example, it can consist of a pump which starts when the fill level in the writing fluid chamber has reached the predetermined lower value.

A fill level sensor arrangement can be provided to determine the fill level in the writing fluid chamber. The fill level sensor arrangement has for example, a contact arm resting against the wall of flexible inelastic material. The position of the contact arm when the lower fill level is reached then will cause an opening of the barrier.

The wall sections of the writing fluid reservoir can be made of a flexible foil, perhaps of a tubular foil, as is described in the above-mentioned U.S. Pat. No. 3,737,242.

However, it is also possible to construct the writing fluid reservoir with a rigid, tube-shaped cylindrical circumferential wall into which a follower piston is inserted, which closes off the writing fluid reservoir toward the back. One construction of this type for a writing fluid reservoir is disclosed in the previously-mentioned German Patent DE-PS 40 13 011.

The invention will be described further and in detail below, wherein references is made to the accompanying drawings illustrating exemplary embodiments.

DETAILED DESCRIPTION OF THE PREFERRED EMBODIMENTS

Figure 1:
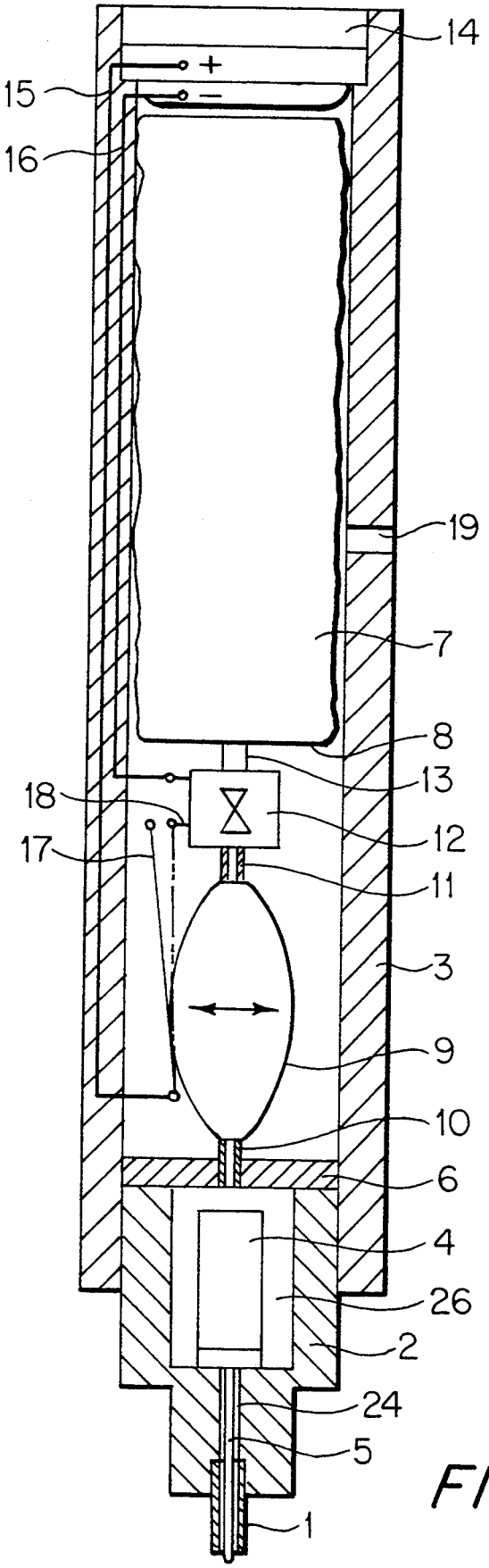
FIG. 1 schematically illustrates a sectional view of a writing or drawing instrument in the form of a stylus pen, which can be used as a hand-held device or can be inserted into the writing head of a plotter.

The stylus pen shown schematically in FIG. 1 has a tube-shaped holder shaft 3, on the front end of which a front part 2 is sealingly fastened. The front part 2 has a center bore 24, and a conventional writing tube 1 is inserted in the front end of the center bore 24. A cleaning wire 5 extends through the center bore 24, and is fastened to a drop weight body 4 which can be moved back and forth in an axially limited manner. The hollow chamber 26 formed in the front part 2 to receive the drop weight body 4 is closed off at the rear by a plate 6, which seals the front part 2 against the interior of the holder shaft 3. A solenoid valve 12 is located at a distance behind the plate 6 and is fastened in the holder shaft 3 in a manner not shown so that it cannot move radially or axially. For example, one suitable solenoid valve 12 weighs only 2 grams, has a power consumption of 250 mW, and is sold by The Lee Company, Westbrook Conn., under the designation "HDI Solenoid Valve."

The solenoid valve 12 has a forward oriented outlet connector 11 to which the inlet of a bubble 9 of a flexible, non-elastic material is sealingly connected. The bubble may have a volume of 0.1 to 0.15 $cm^3$, for example. The front end of the bubble 9 is sealingly connected with a pipe connector 10 extending through the plate 6, thus connecting the interior of the bubble 9 with the interior of the front part 2.

A connector 13 is sealingly placed on the inlet connector of the solenoid valve 12, and is connected with a base plate 8, on which a thin tubular film, closed at the upper end, is fastened. The interior of this tubular film forms a writing fluid reservoir in the manner described in German Patent Application DE-OS 20 35 526, whereby the reservoir will contain only writing fluid and practically no air.

A battery 14, which preferably is in the form of a conventional round cell, is placed on the rear end of the holder shaft 3. The interior of the holder shaft 3 containing the writing fluid reservoir 7 is connected with the ambient air via a transverse bore 19.

The solenoid valve 12 is connected with the battery 14 via conductors 15 and 16. A fixed contact 18 and a pivotable contact 17 are disposed along the length of the conductor 15. The pivotable contact 17 rests under spring pressure against the outer wall of the bubble 9, and will be at a distance from the fixed contact 18 in the manner illustrated in FIG. 1 when the writing fluid level is above a predetermined lower level so as to radially expand bubble 9. In this state the solenoid valve 12 is therefore not excited by the battery 14.

In the state shown in FIG. 1, the bubble 9 contains writing fluid previously supplied from the writing fluid reservoir 7 in a manner described below. When the writing fluid in the front part 2 has been used up, it is replenished from the bubble 9. In this case, the writing fluid in the bubble 9 is at a comparatively short axial distance above the writing tube 1, so that the static pressure acting on the writing tube 1 is very low.

If the fill level in the bubble 9 falls because the writing fluid is being used up, the bubble 9 gradually collapses radially until the pivotable contact 17 approaches the fixed contact 18. At or below a predetermined lower filling level in the bubble 9, the pivotable contact 17 will make electrical contact with fixed contact 18. The voltage applied by the battery 14 to the solenoid valve 12 as a result of this electrically conducting contact opens solenoid valve 12 so that writing fluid will flow from the writing fluid reservoir 7 into the bubble 9. The bubble 9 thereby again is inflated by the flow of writing fluid, until the pivotable contact 17 is displaced away from the fixed contact 18, and the circuit for the solenoid valve 12 is broken. However, as the circuit is broken, the solenoid valve 12 briefly remains open by means of a conventional timer circuit (not shown), so as to distend the bubble 9 with writing fluid up to a predetermined radial dimension; such as illustrated in FIG. 1. Following this time period, the solenoid valve 12 closes again, and closes the fluid connection between writing fluid reservoir 7 and bubble 9.

As writing fluid is delivered out of the writing fluid reservoir 7, the flexible, tubular film delimiting the writing fluid reservoir collapses due to ambient pressure, so that the volume of the writing fluid reservoir 7, which practically contains no air, is slowly reduced. When all writing fluid in the writing fluid reservoir 7 is used up, the user can remove the battery 14 from the rear part of the holder shaft 3, and then withdraw the unit including the tubular film, support plate 8, and connector 13 from the inlet connector of the solenoid valve 12, and replace this unit with the same or another reservoir unit filled with writing fluid.

Figure 2:
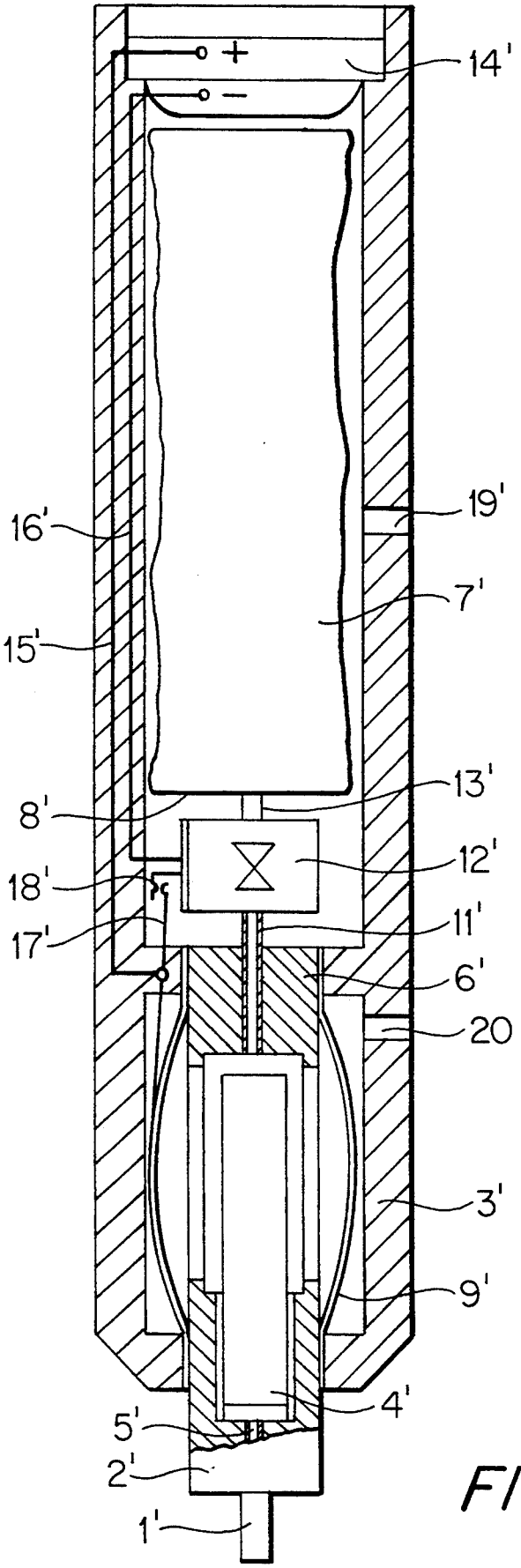
FIG. 2 schematically illustrates a stylus pen which is different from the stylus pen of FIG. 1.

The structure of a second stylus pen embodiment shown in FIG. 2 essentially corresponds to that shown in FIG. 1, and like parts or functionally equivalent parts are identified with the same reference numerals with a prime (') added.

The stylus pen shown in FIG. 2, in contrast to the stylus pen according to FIG. 1, has a bubble 9' that is placed even closer to the writing tube 1'. The rear or upper end of bubble 9' is sealingly clamped between an annular shoulder of the holder shaft 3' and an outer surface on the rear section 6' of the pen front part 2'. The front or lower end of the bubble 9' likewise is sealingly clamped between the front end of the holder shaft 3' and an outer surface on the front part 2'. In this way the bubble 9' is located approximately at the same axial height as the drop weight body 4' and sealingly encloses the front part 2', which has lateral openings to communicate writing fluid into the bubble 9'.

When the solenoid valve 12' opens, writing fluid reaches the chamber of the front part 2' containing the drop weight 4', and the bubble 9' enclosing front part 2' via the outlet connector 11'. Since the outside of the bubble 9′ is connected with the ambient air via a transverse bore 20, ambient pressure acts on the outside of flexible bubble 9′, and on the writing fluid within in bubble 9′.

Figure 3:
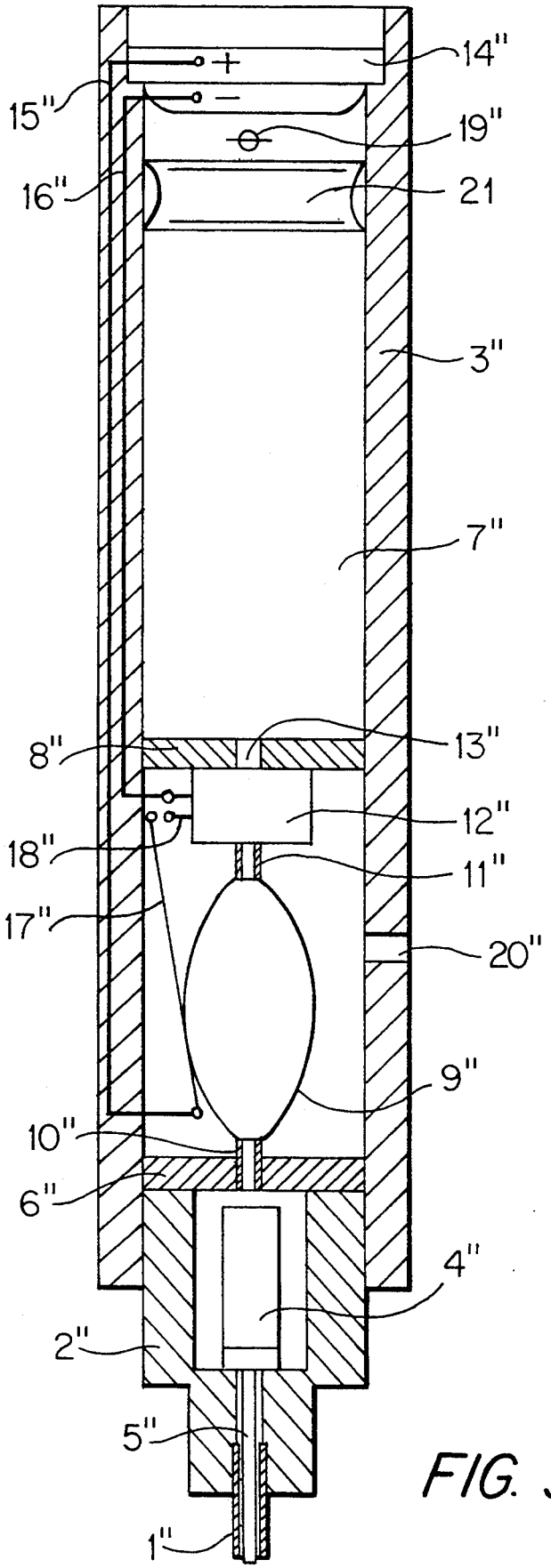
FIG. 3 schematically illustrates a further variation of the stylus pen of FIGS. 1 and 2.

A third stylus pen shown in FIG. 3 also essentially corresponds in structure and function to the pens according to FIGS. 1 and 2, and particularly to the stylus pen shown in FIG. 1. Like parts or functionally equivalent parts of the stylus pen according to FIG. 3 are identified with the same reference numerals as the stylus pens according to FIGS. 1 and 2, but with a double prime (″) added.

In the stylus pen shown in FIG. 3, in direct contrast to the stylus pen according to FIG. 1, a writing fluid reservoir 7″ has been formed which is delimited at its front by a support plate 8″ at its rear by a free piston 21. The circumferential wall of writing fluid reservoir 7″ thereby is formed by the wall of the circular-cylindrical holder shaft 3″. A support plate 8″ has a center opening 13″, and as schematically illustrated a pump 12″ is fastened on the underside of support plate 8″, with an inlet or aspirating opening of pump 12″ being axially aligned with the center opening 13″. An outlet connector 11″ is seated on the output opening of pump 12″. Pumps useful for this embodiment include the micropump developed by the Fraunhofer Institute for Solid Body Technology (Fraunhofer-Institut für Festkörpertechnologie) in Munich, Germany for example, and a diaphragm pump developed by Twente University of the Netherlands, for use in applications such as insulin metering.

If the fill level of the bubble 9″ falls below a predetermined minimum value, as described in connection with FIG. 1, the pump 12″ is activated by the closing of the contacts 17″ and 18″ and will pump writing fluid from the writing fluid reservoir 7″ into the bubble 9″. The strength of the pump 12″ must be sufficient to aspirate writing fluid out of the writing fluid reservoir 7″, and overcome the frictional resistance between circumference of free piston 21 and the inner wall of holder shaft 3″. By means of the suction created due to loss of writing fluid, the follower piston 21 then slowly will move down in the writing fluid reservoir 7″, so that the volume of the writing fluid reservoir 7″ is reduced.

As soon as the pump 12″ is stopped, it forms a fluid-proof barrier between the bubble 9″ and the writing fluid reservoir 7″. Thus, only the hydrostatic pressure of the writing fluid within the bubble 9″, but not the hydrostatic pressure of the writing fluid in the writing fluid reservoir 7″, will be available to exert pressure on the writing tube 1″.

While preferred embodiments of the invention have been shown and described, the invention is to be defined by the scope of the appended claims.

We claim:

1. A writing or drawing instrument, comprising:

a writing tip (1) disposed at a front end of said writing or drawing instrument;

a writing fluid reservoir means (7) for supplying said writing tip (1) with writing fluid, wherein the volume of said writing fluid reservoir means (7) will decrease as writing fluid is used up;

a selectively operated fluid barrier means (12) connected to one end of said writing fluid reservoir means (7);

a writing fluid chamber (9) in fluid connection between said fluid barrier means (12) and said writing tip (1), said writing fluid chamber (9) being adapted to store writing fluid therein and being defined by at least one wall portion comprised of a flexible, inelastic material; and control means for detecting a fill level of writing fluid in said writing fluid chamber (9), for selectively opening said fluid barrier means (12) when writing fluid in said writing fluid chamber (9) reaches a predetermined lower fill level, and for selectively closing said fluid barrier means (12) when writing fluid in said writing fluid chamber (9) reaches a predetermined upper fill level, wherein the predetermined upper fill level is higher than the predetermined lower fill level.

2. A writing or drawing instrument according to claim 1, wherein said writing fluid chamber (9) comprises a flexible, inelastic material, which defines wall portions of a bubble (9).

3. A writing or drawing instrument according to claim 2, wherein said bubble (9) is disposed between said fluid barrier means (12) and said writing tip (1), wherein said bubble (9) is connected to said fluid barrier means (12) through a tube-shaped connector (11), and wherein said bubble (9) is connected to said writing tip (1) through another tube-shaped connector (10).

4. A writing or drawing instrument according to claim 1, wherein said fluid barrier means (12) is opened and closed electrically.

5. A writing or drawing instrument according to claim 4, wherein said fluid barrier means (12) comprises a solenoid valve (12,12′).

6. A writing or drawing instrument according to claim 4, wherein said fluid barrier means (12) comprises a pump (12″).

7. A writing or drawing instrument according to claim 2, wherein said fluid barrier means (12) is opened and closed electrically.

8. A writing or drawing instrument according to claim 7, wherein said fluid barrier (12) comprises a solenoid valve (12,12′).

9. A writing or drawing instrument according to claim 7, wherein said fluid barrier means (12) comprises a pump (12″).

10. A writing or drawing instrument according to claim 1, wherein said control means comprises a fill level sensor arrangement (17,18), which detects a fill level of writing fluid in said writing fluid chamber (9).

11. A writing or drawing instrument according to claim 10, wherein said fill level sensor arrangement (17,18) comprises a contact arm (17) in contact with at least one wall of flexible, inelastic material defining said writing fluid chamber (9), wherein further said fill level sensor arrangement (17,18) detects the fill level of writing fluid within said writing fluid chamber (9) in accordance with a position of said contact arm (17), and wherein said fluid barrier means (12) opens when said fill level sensor arrangement (17,18) detects less than a lower fill level of writing fluid in said writing fluid chamber (9).

12. A writing or drawing instrument according to claim 2, wherein said control means comprises a fill level sensor arrangement (17,18), which detects a fill level of writing fluid in said writing fluid chamber (9).

13. A writing or drawing instrument according to claim 12, wherein said fill level sensor arrangement (17,18) comprises a contact arm (17) in contact with at least one wall of flexible, inelastic material defining said writing fluid chamber (9), wherein further said fill level sensor arrangement (17,18) detects the fill level of writing fluid within said writing fluid chamber (9) in accordance with a position of said contact arm (17), and wherein said fluid barrier means (12) opens when said fill level sensor arrangement (17,18) detects less than a lower fill level of writing fluid in said writing fluid chamber (9).

14. A writing or drawing instrument according to claim 4, wherein said control means comprises a fill level sensor arrangement (17,18), which detects a fill level of writing fluid in said writing fluid chamber (9).

15. A writing or drawing instrument according to claim 14, wherein said fill level sensor arrangement (17,18) comprises a contact arm (17) in contact with at least one wall of flexible, inelastic material defining said writing fluid chamber (9), wherein further said fill level sensor arrangement (17,18) detects the fill level of writing fluid within said writing fluid chamber (9) in accordance with a position of said contact arm (17), and wherein said fluid barrier means (12) opens when said fill level sensor arrangement (17,18) detects less than a lower fill level of writing fluid in said writing fluid chamber (9).

16. A writing or drawing instrument according to claim 1, wherein said writing fluid reservoir means (7,7″) comprises wall portions composed of a flexible foil.

17. A writing or drawing instrument according to claim 16, wherein said flexible foil is a tubular foil.

18. A writing or drawing instrument according to claim 2, wherein said writing fluid reservoir means (7,7″) comprises wall portions composed of a flexible foil.

19. A writing or drawing instrument according to claim 1, wherein said writing fluid reservoir means (7″) comprises a tube-shaped, cylindrical circumferential wall (3″) defining a central bore, and a free piston (21) disposed within the central bore so as to define a rear end of said writing fluid reservoir means (7″).

20. A writing or drawing instrument according to claim 2, wherein said writing fluid reservoir means (7″) comprises a tube-shape, cylindrical circumferential wall (3″) defining a central bore, and a free piston (21) disposed within the central bore so as to define a rear end of said writing fluid reservoir means (7″).

* * * * *